US008233356B2

(12) United States Patent
Saunier

(10) Patent No.: US 8,233,356 B2
(45) Date of Patent: Jul. 31, 2012

(54) TIMEPIECE WITH A MOVABLE HOUR CIRCLE

(75) Inventor: Andre Saunier, Courgenay (CH)

(73) Assignee: Paul Hartzband, Chappaqua, NY (US)

( * ) Notice: Subject to any disclaimer, the term of this patent is extended or adjusted under 35 U.S.C. 154(b) by 229 days.

(21) Appl. No.: 12/744,699

(22) PCT Filed: Jun. 26, 2008

(86) PCT No.: PCT/CH2008/000289

§ 371 (c)(1),
(2), (4) Date: May 26, 2010

(87) PCT Pub. No.: WO2009/067824

PCT Pub. Date: Jun. 4, 2009

(65) Prior Publication Data

US 2010/0302916 A1 Dec. 2, 2010

(30) Foreign Application Priority Data

Nov. 26, 2007 (CH) ..... 1823/07

(51) Int. Cl.
*G04B 25/00* (2006.01)
*G04B 19/16* (2006.01)

(52) U.S. Cl. ..... 368/229; 368/231

(58) Field of Classification Search ..... 368/229, 368/231
See application file for complete search history.

(56) References Cited

U.S. PATENT DOCUMENTS

| | | | | |
|---|---|---|---|---|
| 2,566,741 | A * | 9/1951 | Newhouse | 368/285 |
| 2,847,780 | A * | 8/1958 | Ellerman | 40/584 |
| 5,299,178 | A * | 3/1994 | Belik | 368/76 |
| 5,400,304 | A * | 3/1995 | Offenstein | 368/285 |
| 7,643,381 | B2 * | 1/2010 | Sigelmann | 368/81 |
| 2011/0069590 | A1 * | 3/2011 | Jolidon | 368/15 |
| 2011/0103195 | A1 * | 5/2011 | Wilbur et al. | 368/76 |

FOREIGN PATENT DOCUMENTS

| | | |
|---|---|---|
| CH | 666 380 | 7/1988 |
| CH | 684814 | 1/1995 |
| JP | 2003084079 | 3/2003 |

OTHER PUBLICATIONS

Machine Translation of CH 666380—Source EPO; Apr. 18, 2012.*

* cited by examiner

*Primary Examiner* — Sean Kayes
(74) *Attorney, Agent, or Firm* — Young & Thompson

(57) ABSTRACT

Timepiece with an hour circle formed by a module placed around the movement. The module cover comprises openings at the position of each hour. Inside the module are rockers with decorations in two particular positions. An oscillating mass moves when the inclination of the plane of the timepiece changes and moves the rockers from one position to the other.

13 Claims, 12 Drawing Sheets

Sections A-A et B-B

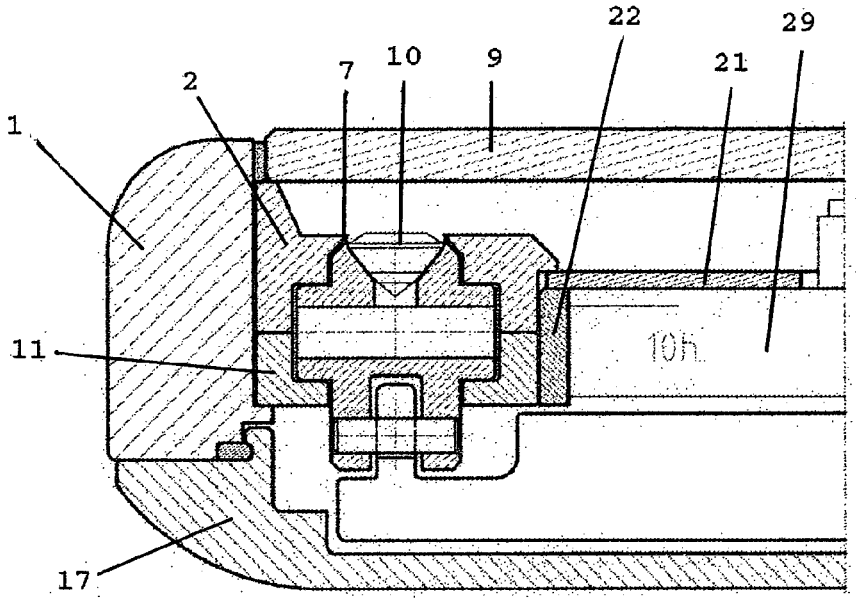
Fig 7 Section C-C
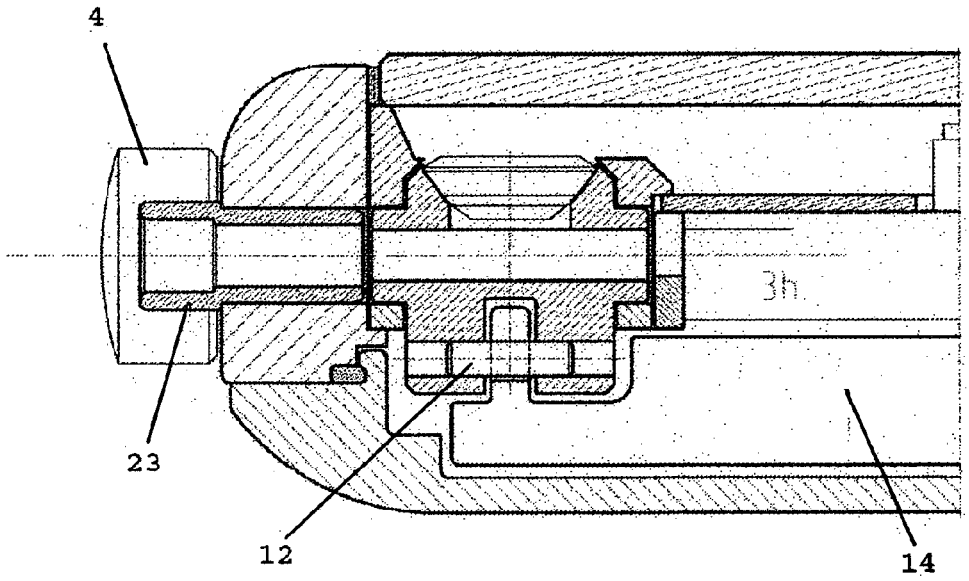
Fig 8 Section D-D

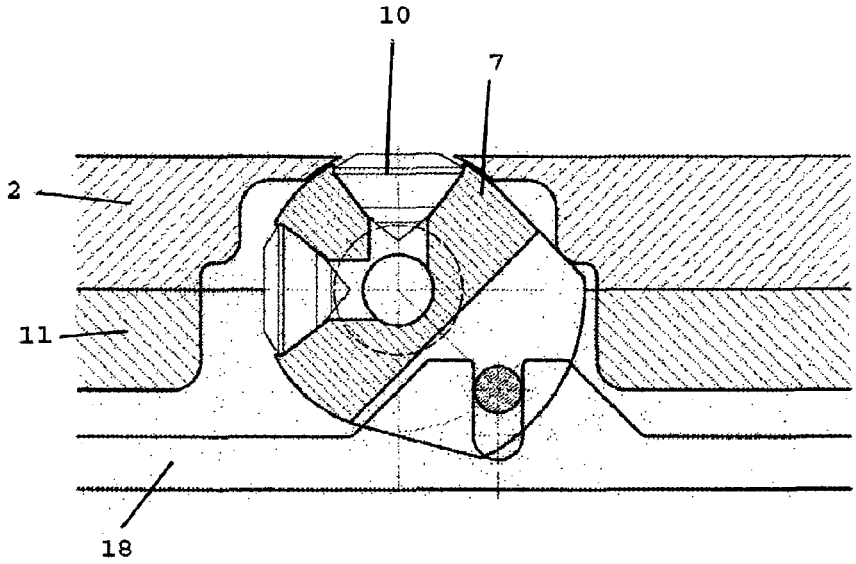
Position A
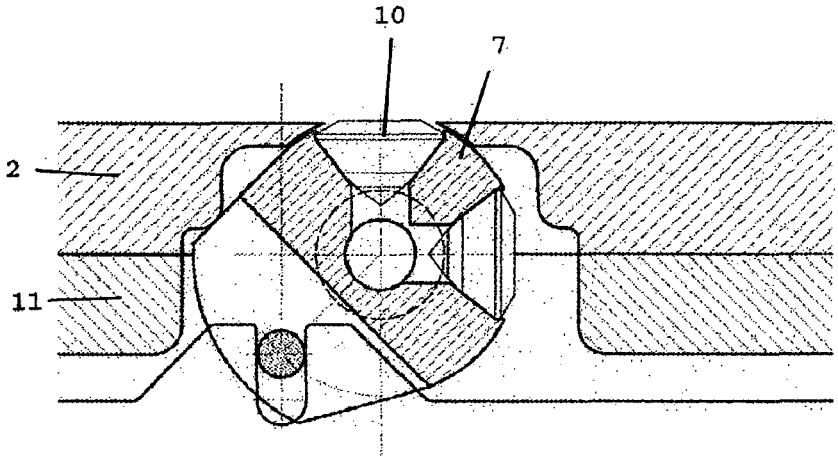
Position B
Fig. 10

TIMEPIECE WITH A MOVABLE HOUR CIRCLE

TECHNICAL FIELD

The present invention relates to a timepiece. The dial constitutes the privileged visible face of that object. Many proposals have already been made to give the dial and the hour wheel esthetic and surprising appearances which arouse interest. With this aim, described below is a movable hour wheel formed by mechanical organs placed around and below the movement.

BACKGROUND OF THE INVENTION

The following patents describe approaches which go in the same direction as the invention, but which do not use the same means and do not achieve the same aim.

Swiss patent CH 684814 describes a timepiece with means making it possible to modify the presentation of the hour circle. A rack is arranged to cooperate with a crown and permit the rotation. At the hour points, studs are provided free in rotation, equipped with satellites engaged with the rack. The prism faces mounted on these studs are set with precious stones, which appear through openings formed in the middle or the dial.

German patent DE 33129 describes a watch dial which makes it possible to see all twenty-four hours of the day. A window, formed at the location where the mention of the hour is located, shows one face of a four-faced body, provided with a staff held by bearings. Inscribed on the faces are the hours corresponding to 1 to 12 and 13 to 24. The staff holding this body is provided with pins which actuate, upon each clock revolution, an arbor, which is itself connected to the staff driving the hands. Upon the passage of the hour hand, the visible face of the body turns by one quarter revolution and goes, for example, from one o'clock to thirteen o'clock.

Swiss patent CH 666380 describes a watch provided with movable decorative elements. The watch case includes a decorative disc with windows, turning freely along the axis of the hands, and a second movable disc, provided on its periphery with an increasing portion set with brilliants and creating an unbalance, turning freely along the same axis as the first decorative disc. The movement of these decorative elements around the dial of the watch is random, which constitutes the similarity with the invention.

Japanese patent JP 2003084079 describes a clock where the figures of the hour circle are inscribed on doors which can open at determined moments. The doors are distributed by groups of three which open successively according to a program acting through electrical commands. Behind the doors are various decorations. The reversed sequences close the doors of each group of three.

BRIEF DESCRIPTION OF THE INVENTION

The aim of the invention is to create an esthetic effect by variation of the hour circle, under the action of aan oscillating mass which moves according to the position of the arm and which causes levers to turn. These levers are provided with two decorative faces, which can be set with stones or bear the mention of the hour. Upon each tilt, the other face appears in the windows arranged to that end in the dial. The claims more precisely define a timepiece according to the invention.

BRIEF DESCRIPTION OF THE DRAWINGS

The invention is presented in more detail using one embodiment, chosen completely non-limitingly and described below using the following figures:

FIG. 3 3D view of the cover of the module;

FIG. 5 3D view of the base of the module, from below;

FIG. 7 Cross-section C-C of a lever at 10 o'clock;

FIG. 8 Cross-section D-D of a lever at 3 o'clock;

FIG. 10 Cross-section showing the two positions of a lever;

DETAILED DESCRIPTION OF THE INVENTION

Figure 1:
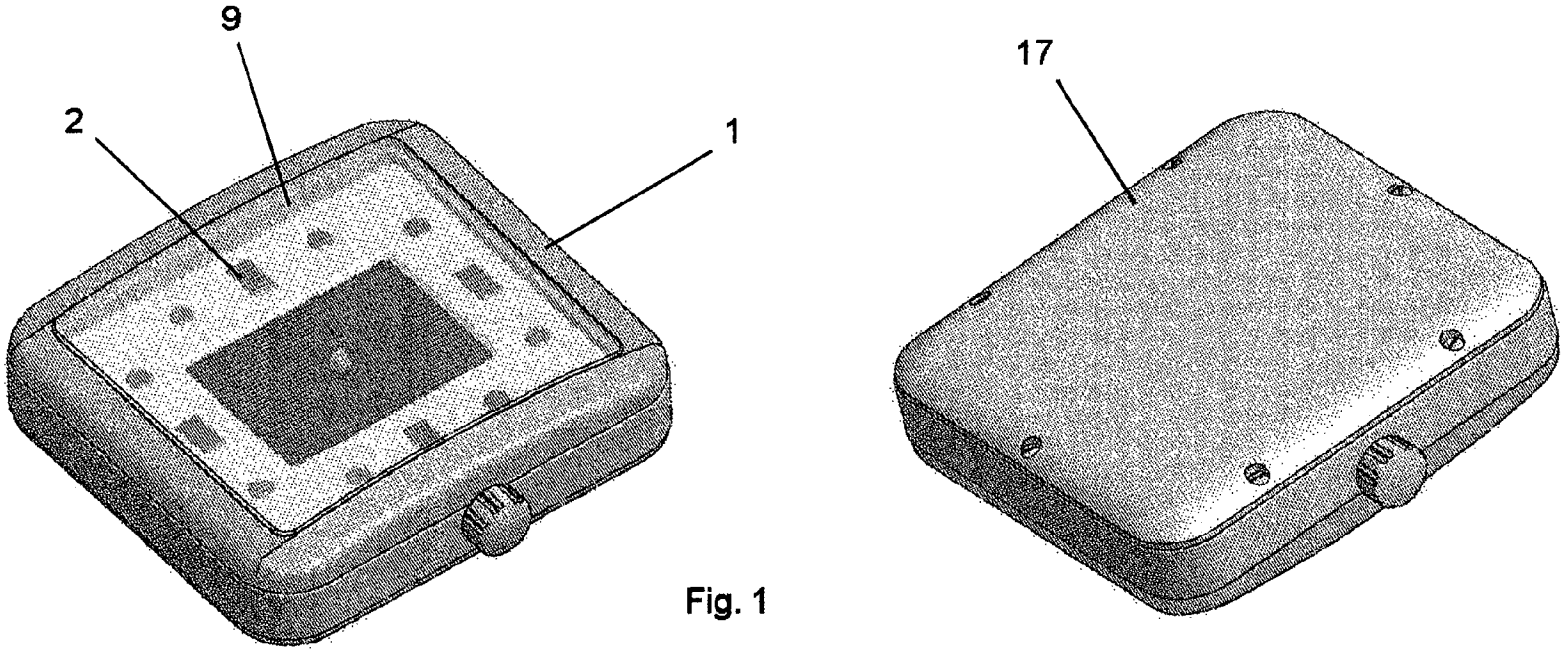
FIG. 1 Two 3D views of a timepiece according to the invention.
Figure 2:
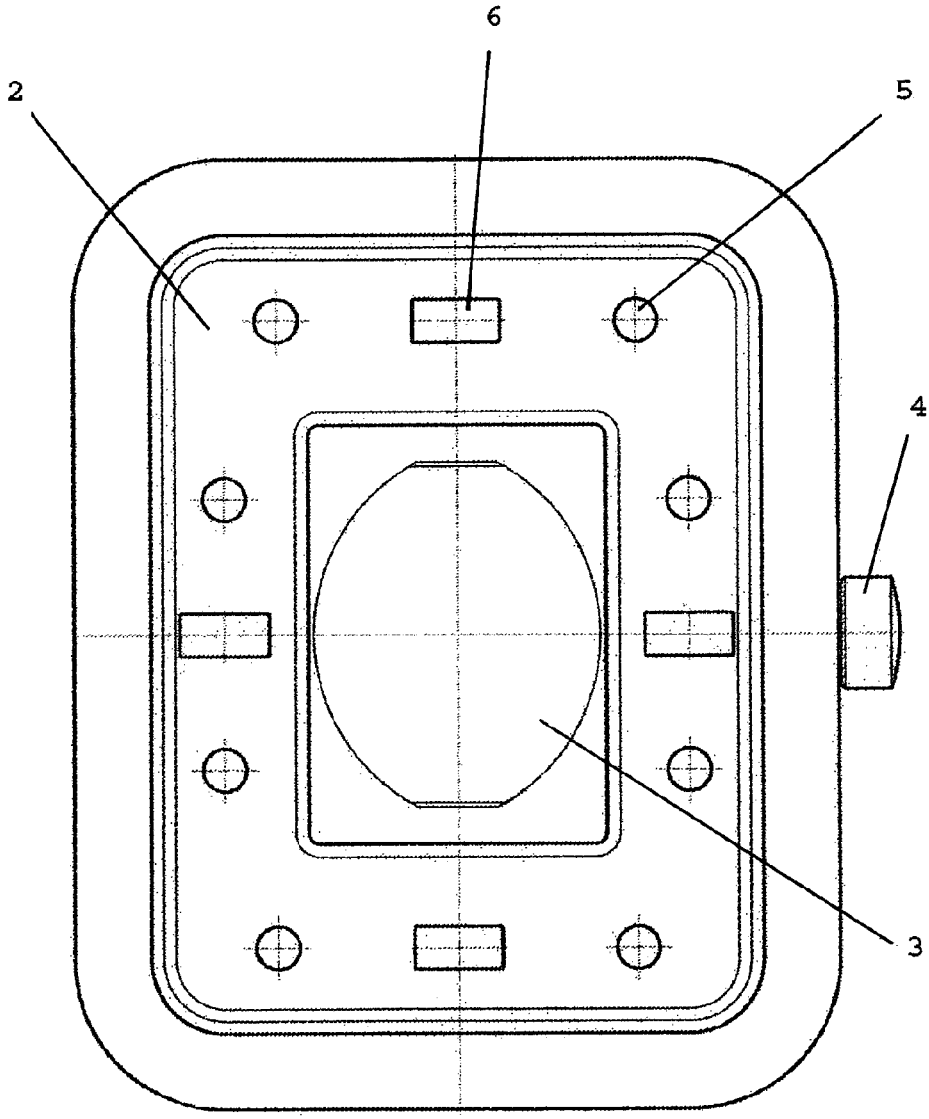
FIG. 2 Outline sketch of the cover of the module, according to the invention.
Figure 3:
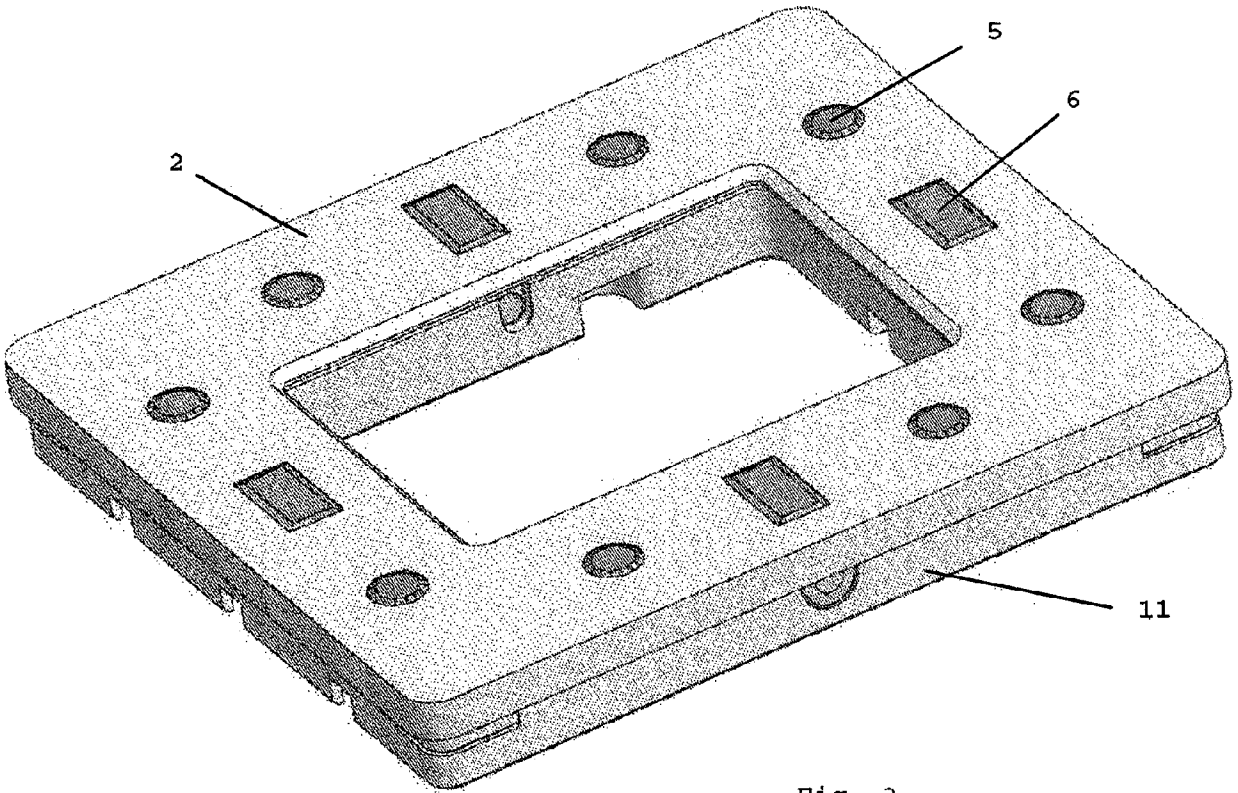

FIG. 1 shows the timepiece, from above and below. The case 1 is provided with a glass 9 through which the module 2 is visible. The cover of this module 2, which appears in FIG. 2, comprises a face pierced with round 5 or rectangular 6 openings. The center of the module 2 is crossed out to make room for the movement. The 3D view of FIG. 3 provides an illustration of the two pieces of the module, the cover 2 mounted on the base 11.

Figure 4:
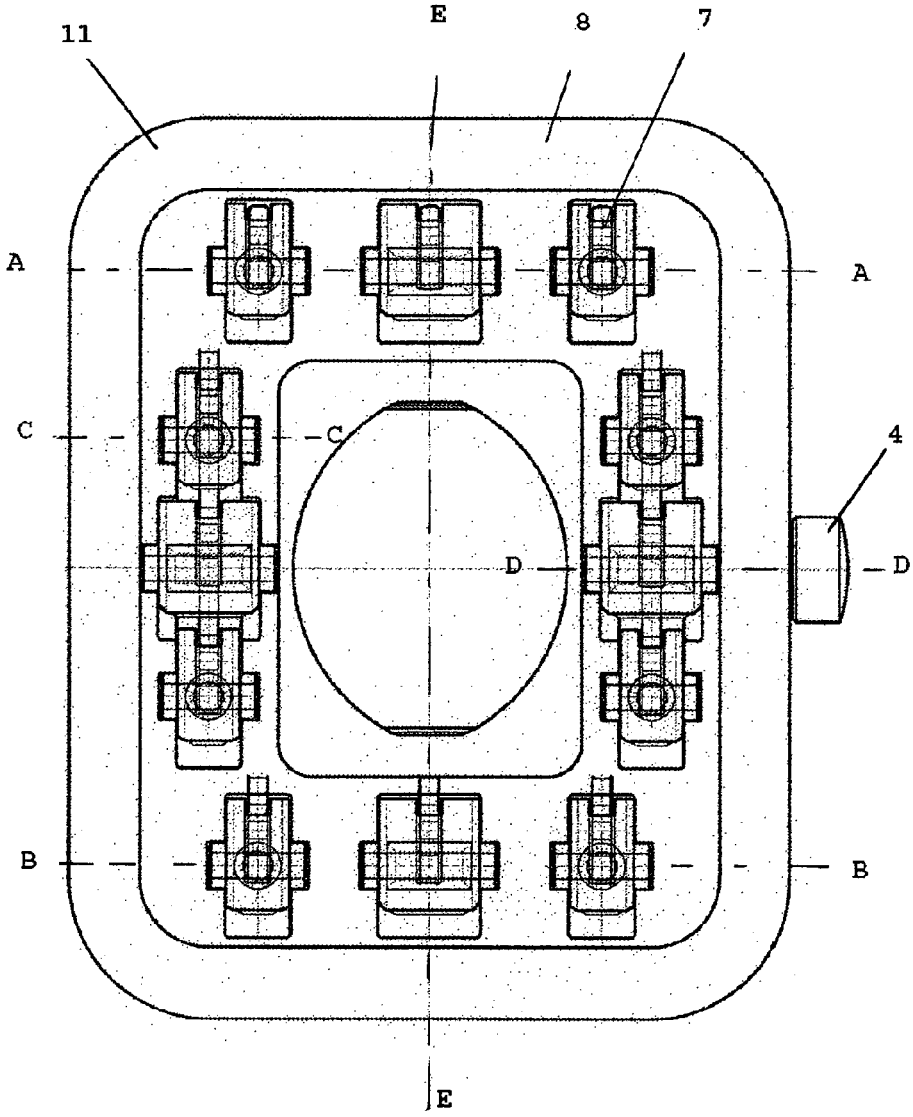
FIG. 4 Outline sketch of the cover of the module.
Figure 5:
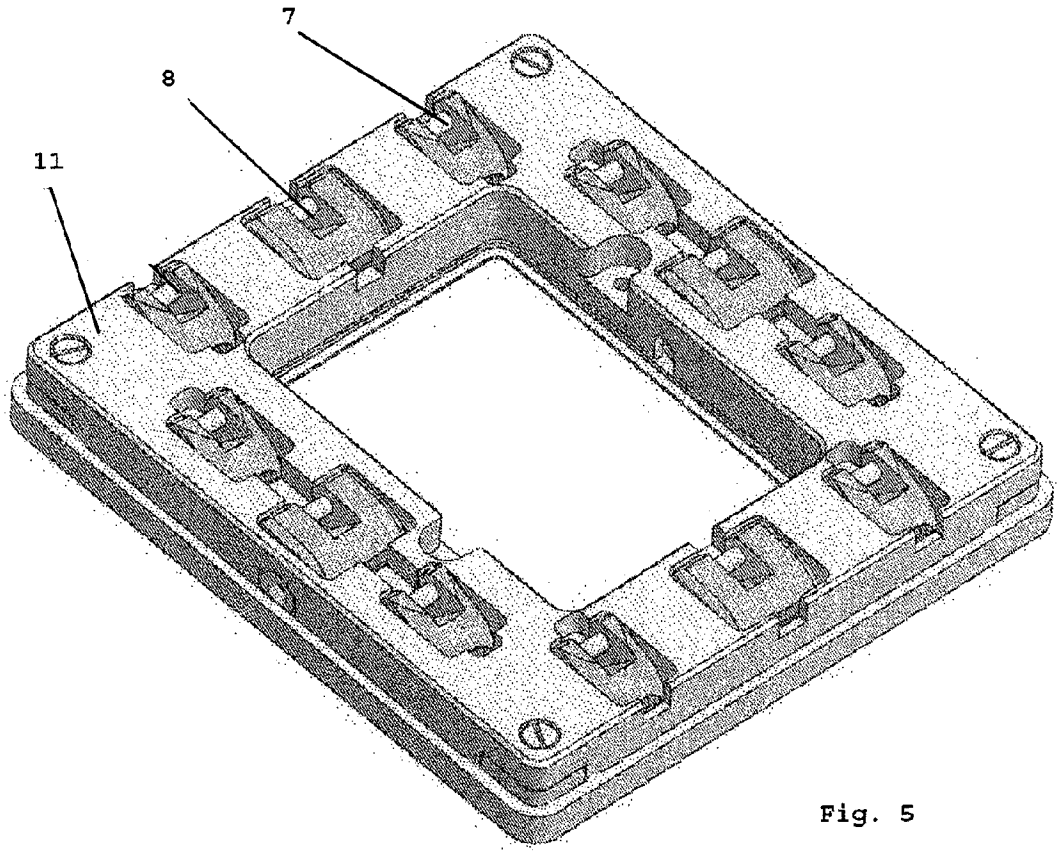

FIG. 4 is a bottom view of the base of the module 11, provided with twelve levers 7 and 8. In this embodiment, four levers support rectangular stones and eight support round stones. The cross-section lines A-A, B-B, C-C, D-D and E-E are illustrated and described below. FIG. 5 is a 3D view of the same piece. The hollow in the center of the module, for the placement of the movement 29, is clearly visible.

Figure 6:
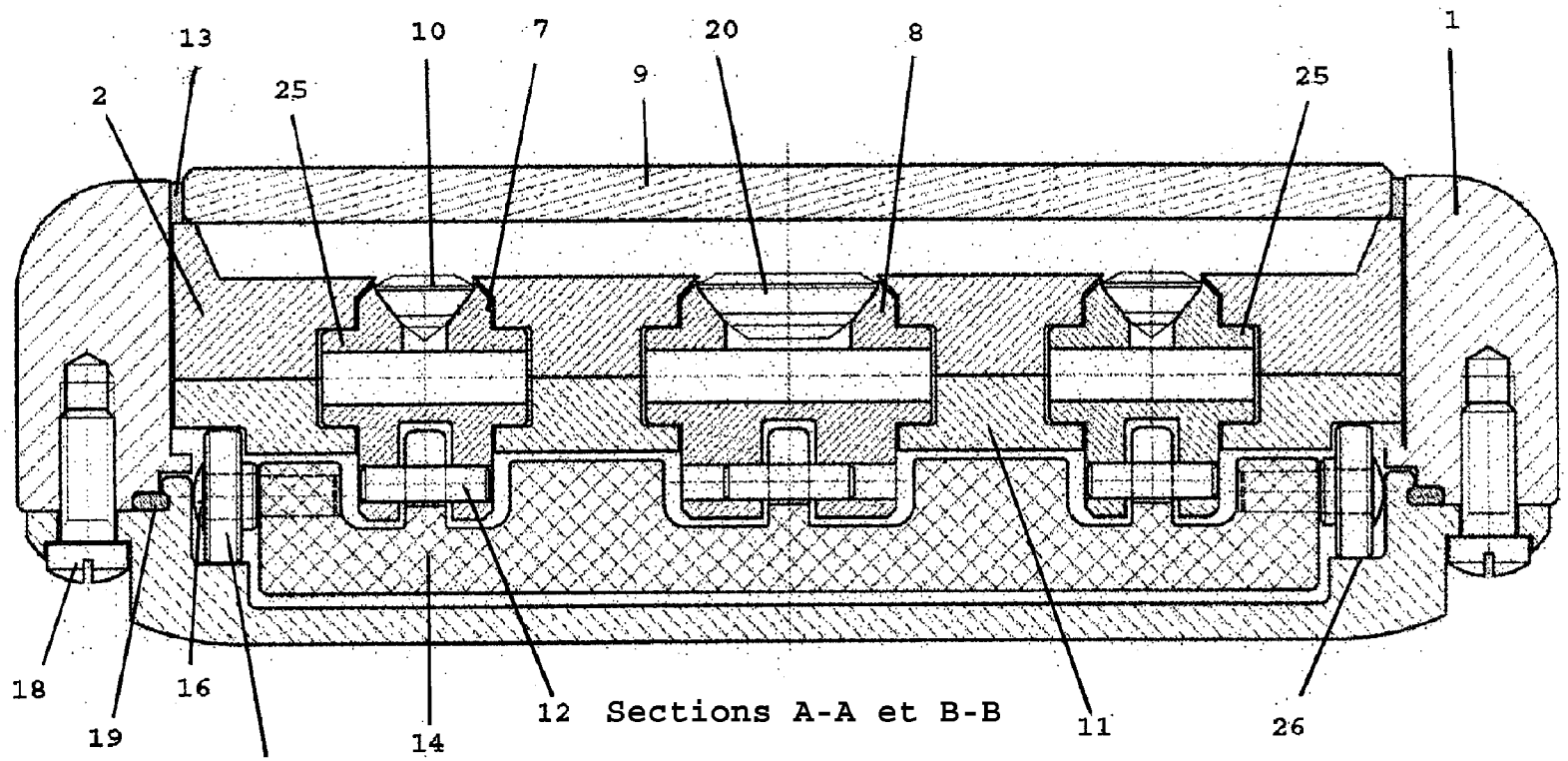
FIG. 6 Cross-sections A-A and B-B of the entire timepiece.

FIG. 6 is the illustration of cross-sections A-A and B-B of the timepiece assembly. The outer envelope comprises the case 1, the glass 9 and the bottom 17. The module comprises the cover 2 and the base 11. This module contains the levers 7, 8 on which the stones 10, 20 are mounted. The levers 7, 8 are provided with staffs 25 which cooperate with bearings formed in the two parts of the module 2, 11 allowing their rotation. The levers 7, 8 are still provided with pins 12, which cooperate with the forks 28 of the oscillating mass 14, itself placed on the bottom 17. This mass can only move longitudinally. Laterally, it is provided with runners 15 which roll on tracks 26. The heads of the staffs 16 serve as lateral stops. When the case is inclined in the longitudinal axis, the mass 17 moves until it encounters the stop of the bottom 27. An incline in the other direction causes the contrary movement. By moving, the oscillating mass 1417 drives, through the pins 12, the levers 7, 8, causing the change of the stones of the hour circle.

FIG. 7 is a C-C cross-section of the assembly at 10 o'clock. The dial 21 is positioned: here it serves only to hide the movement 29. FIG. 8 is the D-D cross-section of the assembly, at 3 o'clock. The particularity of this position is the passage left free for the crown shaft through the tube 23 and the hole formed in each lever 7, 8. Another possibility is to place the crown between two hours, for example between 3 o'clock and 4 o'clock.

Figure 9:
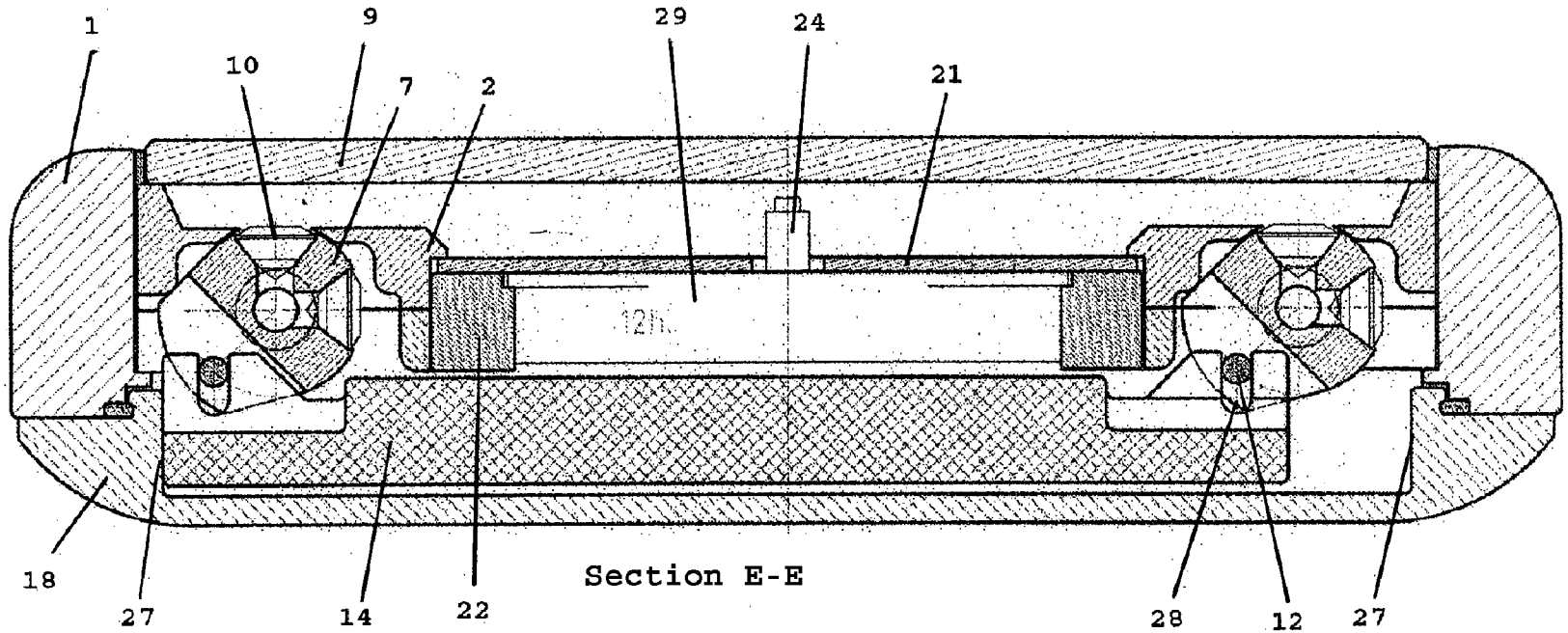
FIG. 9 Cross-sections E-E of the assembly.
Figure 11:
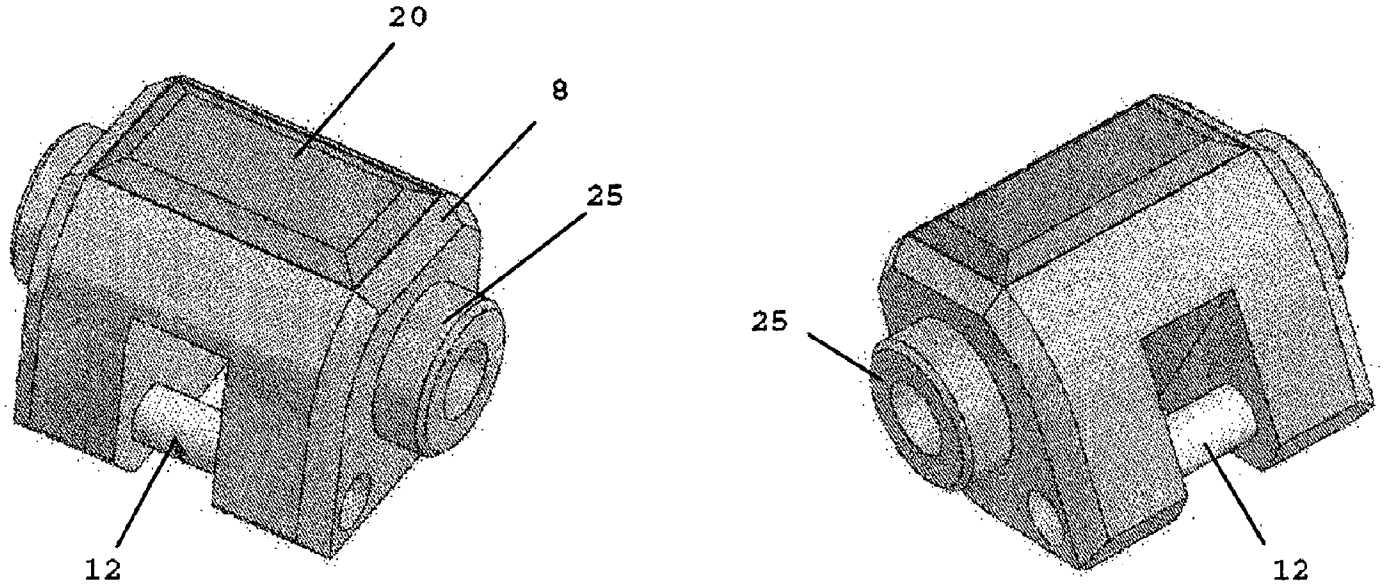
FIG. 11 Two 3D views of a lever with rectangular stone.
Figure 12:
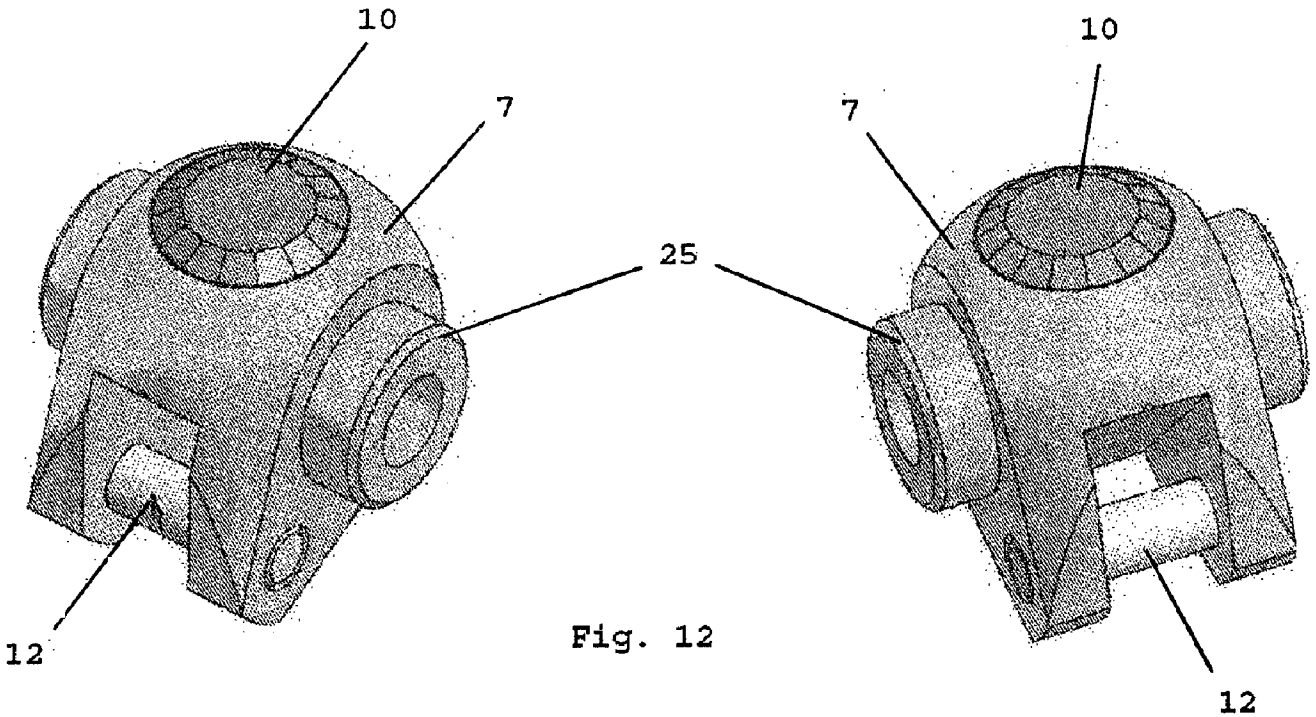
FIG. 12 Two 3D views of a lever with round stone.

FIG. 9 is a 6:00-12:00 cross-section of the assembly. The levers 7 cooperate with the mass 14 via forks 28 which are clearly visible. FIG. 10 shows the two extreme positions of a lever 7, which shows turn by turn one or the other stone 10. It must be noted that a free space puts each stone 10 in contact with the orifice 30. This channel can be used as a lightwave guide in case of lighting of the stones 10, 20 by diodes (not shown). FIGS. 11 and 12 are 3D views of the levers 7, 8.

Figure 13:
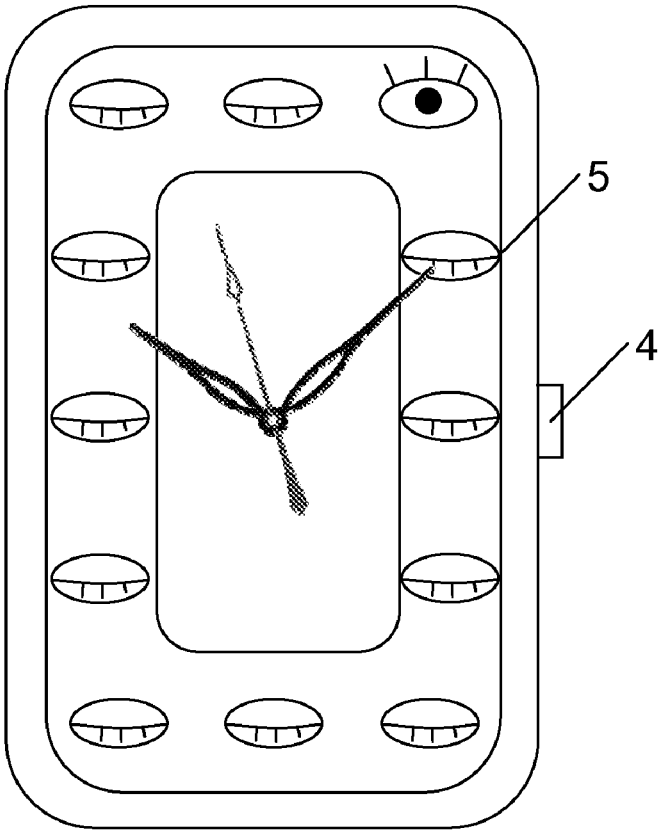
FIG. 13 Depicts an embodiment wherein an eye and eyelid are used as an illustration.

Among the other embodiments, it must be mentioned that the decoration of the levers can be quite varied. Instead of stones, there can be symbols, signs or illustrations. One embodiment (depicted in FIG. 13) illustrates an eye on one position and an eyelid on the other position, the outer face of the cover of the module contributing, through its decoration, to completing the shape of the eye. Thus, when the levers 7, 8 change position, each eye opens or closes.

Another embodiment concerns the lighting of the stones 7, 8. The idea to save the energy of the battery is to launch a flash by opening a contact as the mass 14 passes or only to light a limited number of stones. Another possibility is to create a sound or noise upon each movement of the oscillating mass.

These examples show that the invention uses creativity to achieve surprising and esthetic effects.

Nomenclature

1. Case
2. Module, cover
3. Location for the movement
4. Crown
5. Round opening
6. Rectangular opening
7. Lever for round stone
8. Lever for rectangular stone
9. Glass
10. Round stone
11. Module, base
12. Pin
13. Glass joint
14. Oscillating mass
15. Runner
16. Runner staff
17. Bottom of shape
18. Closing screw
19. Shape joint
20. Rectangular stone
21. Dial
22. Casing-ring
23. Driving-in tube
24. Hand pipe
25. Lever staff
26. Rolling track
27. Bottom stop
28. Fork
29. Movement

The invention claimed is:

1. A timepiece, wherein an envelope is formed by a case, a glass and a bottom, said timepiece comprising a movable hour circle comprising levers which can turn under the action of an oscillating mass capable of moving according to positions of a support arm, said levers being provided with two decorated sites, appearing alternatingly upon each tilt, in openings arranged to that end in a dial visible through the glass.

2. The timepiece of claim 1, comprising a module made up of a cover and a base in which said levers are mounted rotatingly in said module, said openings being formed in the cover of the module to allow said decorated sites to appear, said levers being provided with staffs which cooperate with bearings formed in the two parts of the module permitting the rotation of said levers, said levers also being provided with pins, which cooperate with forks, integral parts of said oscillating mass, to be driven from a position (A), in which one of the two sites is visible, to another position (B), in which the other of the two sites is visible, and vice versa when the oscillating mass moves, and wherein said oscillating mass is longitudinally movable and is provided laterally with runners, mounted on staffs, said staffs including heads serving as lateral stops for the oscillating mass, said runners rolling on tracks during the longitudinal movement of the oscillating mass, this movement being caused by the change of incline of the longitudinal plane of the timepiece.

3. The timepiece of claim 2, wherein the decorations of the determined sites can be stones, symbols, signs or figurative representations.

4. The timepiece of claim 3, wherein the decorations of the determined sites can be the illustration of an eye on one of the positions while the other illustrates an eyelid, the movement of the lever giving the illusion of an eye which opens or closes.

5. The timepiece of claim 2, wherein the decorations of the determined sites can be the illustration of an eye on one of the positions while the other illustrates an eyelid, the movement of the lever giving the illusion of an eye which opens or closes.

6. The timepiece of claim 3, wherein lateral guiding of the oscillating mass is done by slide-ways.

7. The timepiece of claim 2, wherein lateral guiding of the oscillating mass is done by slide-ways.

8. The timepiece of claim 1, wherein the decorations of the determined sites can be the illustration of an eye on one of the positions while the other illustrates an eyelid, the movement of the lever giving the illusion of an eye which opens or closes.

9. The timepiece of claim 8, wherein lateral guiding of the oscillating mass is done by slide-ways.

10. The timepiece of claim 1, wherein the decorations of the determined sites can be stones, symbols, signs or figurative representations.

11. The timepiece of claim 10, wherein the decorations of the determined sites can be the illustration of an eye on one of the positions while the other illustrates an eyelid, the movement of the lever giving the illusion of an eye which opens or closes.

12. The timepiece of claim 10, wherein lateral guiding of the oscillating mass is done by slide-ways.

13. The timepiece of claim 1, wherein lateral guiding of the oscillating mass is done by slide-ways.

* * * * *